US009353536B2

(12) United States Patent
Yamakawa

(10) Patent No.: US 9,353,536 B2
(45) Date of Patent: May 31, 2016

(54) REINFORCING STRUCTURE FOR CONCRETE COLUMN

(71) Applicant: Sanyohome Co., Ltd., Ibaraki (JP)

(72) Inventor: Hiroshi Yamakawa, Ibaraki (JP)

(73) Assignee: Sanyohome Co., Ltd., Ibaraki (JP)

( * ) Notice: Subject to any disclaimer, the term of this patent is extended or adjusted under 35 U.S.C. 154(b) by 0 days.

(21) Appl. No.: 14/653,341

(22) PCT Filed: Jan. 15, 2014

(86) PCT No.: PCT/IB2014/058277
§ 371 (c)(1),
(2) Date: Jun. 18, 2015

(87) PCT Pub. No.: WO2014/111851
PCT Pub. Date: Jul. 24, 2014

(65) Prior Publication Data

US 2015/0345159 A1 Dec. 3, 2015

(30) Foreign Application Priority Data

Jan. 17, 2013 (JP) ..... 2013-006483
Jan. 17, 2013 (JP) ..... 2013-006486

(51) Int. Cl.
*E02D 37/00* (2006.01)
*E04G 23/00* (2006.01)
*E04G 23/02* (2006.01)

(52) U.S. Cl.
CPC ..... *E04G 23/0218* (2013.01); *E04G 23/0225* (2013.01); *E04G 2023/0251* (2013.01)

(58) Field of Classification Search
CPC ..... E04G 23/0218; E04G 23/0225; E04G 2023/0251; E02D 5/64; E02D 5/60; E04C 3/34
See application file for complete search history.

(56) References Cited

U.S. PATENT DOCUMENTS 3,355,852 A * 12/1967 Lally ..... E04B 1/943 52/202
3,798,867 A * 3/1974 Starling ..... E02D 5/64 52/742.14

(Continued)

FOREIGN PATENT DOCUMENTS

JP H09-177334 A 7/1997
JP H10-220030 A 8/1998

(Continued)

OTHER PUBLICATIONS

Translation of Nishiyama et al. (JP 1181554) provided by espacnet.*

(Continued)

*Primary Examiner* — Brian Mattei
(74) *Attorney, Agent, or Firm* — Renner, Otto, Boisselle & Sklar, LLP

(57) ABSTRACT

A reinforcing structure for a concrete column is provided, which is capable of preventing the concrete column from being destroyed. A reinforcing structure for a concrete column comprises: a plurality of steel plates 6, overlapping portions of which are arranged to be slidable with each other by vibration due to an external force; grout material 7 filled into a space portion 3 formed in between the plurality of steel plates 6 and a concrete column 1; and a reinforcing sheet 5 with adhesive wound around an outer circumference of the plurality of steel plates 6, wherein: the plurality of steel plates 6 are bound by the reinforcing sheet with adhesive. Preferably, a restricting portion 12 is provided for restricting sliding movement of the overlapping portions, at the overlapping portions of the plurality of steel plates 6.

9 Claims, 9 Drawing Sheets

(56) References Cited

U.S. PATENT DOCUMENTS

| | | | | | |
|---|---|---|---|---|---|
| 4,071,996 | A * | 2/1978 | Muto | E04H 9/02 | 264/35 |
| 4,306,821 | A * | 12/1981 | Moore | E02D 5/64 | 405/211 |
| 4,439,071 | A * | 3/1984 | Roper, Jr. | E02D 5/60 | 249/48 |
| 4,892,601 | A * | 1/1990 | Norwood | E02D 5/64 | 156/185 |
| 6,006,488 | A * | 12/1999 | Okitomo | E02D 5/60 | 405/216 |
| 2003/0089063 | A1 * | 5/2003 | Igarashi | E04G 23/0218 | 52/405.2 |
| 2013/0055660 | A1 * | 3/2013 | Chang | E04G 23/0218 | 52/167.1 |

FOREIGN PATENT DOCUMENTS

| | | | |
|---|---|---|---|
| JP | H11-81554 | A | 3/1999 |
| JP | 2005-023745 | A | 1/2005 |
| JP | 2005-350878 | A | 12/2005 |
| JP | 2007-002512 | A | 1/2007 |
| JP | 2009-095910 | A | 5/2009 |
| JP | 2012-007418 | A | 1/2012 |
| JP | 2012-036636 | A | 2/2012 |

OTHER PUBLICATIONS

International Search Report for corresponding International Application No. PCT/IB2014/058277 mailed Apr. 14, 2014.

Patent Examination Report for corresponding Australian Application No. 2014206512 issued Dec. 15, 2015.

* cited by examiner

REINFORCING STRUCTURE FOR CONCRETE COLUMN

TECHNICAL FIELD

The present invention relates to a structure for reinforcing a concrete column of a structure.

BACKGROUND ART

In recent years, concrete structures such as reinforced concrete columns and beams have received significant damage due to the large earthquakes that have occurred over many places. Investigations point out that the cause of the damage is due to the shear failure of concrete structures. Investigations identify that such damage is caused by the increasing of shear failure due to multiple alternating cyclic deformation during strong earthquakes. Thus, effective restraining of concrete structures is known to be important, in order to prevent shear failure of concrete structures and secure the stability and persistence for resilience characteristics against such repeated force.

A variety of types of reinforcement have been conventionally provided for existing reinforced concrete columns in order to increase the earthquake resistance of the reinforced concrete columns.

An example of such a reinforcing method is such that a pair of steel plates, a cross-sectional surface of which forms a U-shaped, are arranged around a reinforced concrete column, and end portions of the steel plates are butted to each other. The butted portions are welded to joint the steel plates with each other, and grout material is filled into a space portion formed in between the reinforced concrete column and the steel plates. According to this reinforcing method, the steel plates can be closely adhered to the reinforced concrete column via the grout material, thereby reinforcing the reinforced concrete column.

In this reinforcing method, since the end portions of the pair of steel plates are welded with each other, sparks produced during the welding operations may ignite flammable materials in the periphery to cause a fire. Moreover, it is necessary to place the end portions of the pair of steel plates accurately with each other, which requires accuracy in butting of end portions in the butted portions.

Concrete structures for forming a tunnel, which pierces a mountain and through which rail tracks and roads are laid, and concrete structures for forming stores and houses, which utilize the space underneath elevated railway tracks, are required to be reinforced for earthquake resistance, due to long-term deterioration.

When a reinforced concrete column is reinforced using a method for welding a steel plate including the above-mentioned reinforcing method, steel plates of 9 mm or more in thickness are required. Since such steel plates are heavy, heavy machinery will be essential for the transportation and construction of the steel plates. However, it is often the case that such heavy machinery cannot be brought into tunnels or underneath the elevated railway tracks. Thus, construction that can be performed with only manpower is desired.

A reinforcing method for binding a reinforced concrete column without welding steel plates is also proposed. For example, Japanese Laid-Open Publication No. 9-177334 (Patent Literature 1) proposes a technique of overlapping end portions of steel plates 40 enclosing a reinforced concrete column 1, connecting the end portions with bolts and nuts 41, and filling grout material into a space portion 42 in between the reinforced concrete column 1 and the steel plates 40, as shown in FIG. 15.

Japanese Laid-Open Publication No. 10-220030 (Patent Literature 2) proposes a technique of forming a teeth-shaped engaging portion 44 at both end portions of an steel plate 43, overlapping and engaging the engaging portions 44 and 44 of the adjacent steel plates 43 and 43 to fasten the steel plates 43 and 43, and filling grout material into a space portion 42 in between the reinforced concrete column 1 and the steel plates 43, as shown in FIG. 16.

According to these reinforcing methods for reinforced concrete columns, there is no need to worry about fire hazard due to welding, and accuracy is not required for the butting of the end portions of the butted portions.

Furthermore, in order to reinforce the column 1 in a sufficient manner, it is necessary to secure a space portion of an appropriate size in between the steel plates and the column 1 and fill the space portion with a predetermined amount of grout material. If the amount of the grout material to be filled is less than necessary, then the reinforcement will not be sufficient. On the other hand, if the amount of the grout material to be filled is more than necessary, then the cost for the construction will increase.

However, with the reinforcing methods described in Patent Literatures 1 and 2, the size of the space portion in between the steel plates and the reinforced concrete column 1 is determined in accordance with the size of the steel plates and column. Thus, it is not possible to adjust the size of the space portion appropriately in accordance with the size or the like of the column 1. Furthermore, since the subject reinforcing methods reinforce columns using only the steel plates and grout material, the reinforced, reinforced concrete column does not have sufficient toughness against repeated deformation during strong shakes. Thus, the shear capacity is low.

Thus, Japanese Laid-Open Publication No. 2005-23745 (Patent Literature 3) proposes a reinforcing method, where four steel plates 45, cross-section of which is formed in an L-shape, are arranged around the corner portions of a reinforced concrete column 1 as shown in FIG. 17. End portions of the adjacent steel plates 45 and 45 are overlapped with each other, and then a belt-shaped fiber sheet 46 is wound around the outer periphery of the steel plates 45 to bind the four steel plates 45. Grout material is filled into a space portion 42 formed in between the four steel plates 45 and the reinforced concrete column 1.

According to this reinforcing method, the steel plates 45 can be slid in accordance with the size of the outer shape of the reinforced concrete column 1, which means that the size of the space portion 42 in between the steel plates 45 and the reinforced concrete column 1 is changeable. Furthermore, if a shear force works on the reinforced concrete column 1, the steel plates 45 will slide with each other so that the force will be transmitted to the belt-shaped fiber sheet 46. Thus, the toughness of the reinforced concrete column 1 will be increased and the earthquake resistance will be improved for the reinforced concrete column 1.

However, if the shear force working on the reinforced concrete column 1 is too great, all the shear force may work on the belt-shaped fiber sheet 46 and the belt-shaped fiber sheet 46 may be cut off. Although the belt-shaped fiber sheet 46 is normally cut for the first time when in contact with sharp objects such as a blade, it will be naturally cut off if the shear force working on the belt-shaped fiber sheet 46 is too great and rapidly and exceeds the limit of the tension of the belt-shaped fiber sheet 46. If the belt-shaped fiber sheet 46 is cut off, the reinforced concrete column 1 will be completely destroyed.

The techniques disclosed in these prior art documents are all on the premise that there is a space around the column to be reinforced, and a wall surface is not in contact with the column and not in connection with each other. Accordingly, the abovementioned technique cannot be applied for the reinforcing measures of, for example, concrete columns constituting a tunnel, in a formation where the wall surface is in connection with the column.

A reinforcing method of a reinforced concrete column for a formation where a wall surface is in contact with a column is described in Japanese Laid-Open Publication No. 2012-7418 (Patent Literature 4).

As shown in FIG. 18, this reinforcing method is such that a pair of steel plates 52 and 52 are slidably arranged against an outer wall surface of a reinforced concrete column 1, the pair of the steel plates 52 and 52 are bound by a reinforcing sheet 47, and grout material 57 is filled into a space portion formed in between the pair of steel plates 52 and 52 and the reinforced concrete column 1. Note that the numeral 53 in the figure denotes a wall.

This reinforcing method, however, is rather a method for increasing the strength and bending strength of the reinforced concrete column 1, and it will not increase the toughness of the reinforced concrete column 1. Thus this reinforcing method has a great defect of making the strength between the entire structure and the column imbalanced and the earthquake resistance will not be improved.

CITATION LIST

Patent Literature

PTL 1: Japanese Laid-Open Publication No. 9-177334
PTL 2: Japanese Laid-Open Publication No. 10-220030
PTL 3: Japanese Laid-Open Publication No. 2005-23745
PTL 4: Japanese Laid-Open Publication No. 2012-7418

SUMMARY OF INVENTION

Technical Problem

The present invention is intended to solve the conventional problems described above. An objective of the present invention is to provide a reinforcing structure for a concrete column, which reinforcing structure does not require welding of connections of steel plates and is safe and has excellent construction characteristics.

Another objective of the present invention is to provide a reinforcing structure for a concrete column, which reinforcing structure is capable of changing the size of an internal space portion surrounded by steel plates by sliding steel plates in accordance with the size or the like of the concrete column, so that a set amount of grout material will be filled into the space portion and the concrete column will be sufficiently reinforced.

Still another objective of the present invention is to provide a reinforcing structure for a concrete column, which reinforcing structure improves the earthquake resistance of the concrete column even if shear force works on the concrete column.

Still another objective of the present invention is to provide a reinforcing structure for a concrete column, which reinforcing structure is capable of preventing a belt-shaped fiber sheet from being cut off and preventing the concrete column from being destroyed even if shear force works greatly and rapidly on the concrete column.

Still another objective of the present invention is to provide a reinforcing structure for a concrete column with excellent earthquake resistance, which reinforcing structure allows for the construction of a concrete column used in a tunnel only from the side of the concrete column closer to the tunnel, even when such a concrete column is in connection with a wall surface.

Still another objective of the present invention is to provide a reinforcing structure for a concrete column, which reinforcing structure allows for the construction only with manpower even when a concrete column is reinforced at a place, such as in a tunnel or underneath elevated railway tracks, into which heavy machinery cannot be brought.

Solution to Problem

In order to solve the problems described above, the present invention is characterized as follows.

The concrete column referred in the present invention includes a reinforced concrete column, a steel-frame reinforced concrete column, a steel pipe concrete column, and a steel frame column. In general, although the steel frame column does not contain concrete therein, the steel frame column is also included in the concrete column in the present invention.

A reinforcing structure for a concrete column according to the present invention comprises: a plurality of steel plates, overlapping portions of which are arranged to be slidable with each other by vibration due to an external force; grout material filled into a space portion formed in between the plurality of steel plates and a concrete column; and a reinforcing sheet with adhesive wound around an outer circumference of the plurality of steel plates, where: the plurality of steel plates are bound by the reinforcing sheet with adhesive, thereby achieving the objective described above.

Preferably, in the reinforcing structure for the concrete column according to the present invention, the overlapping portions are provided with a restricting portion for restricting sliding movement of the overlapping portions of the plurality of steel plates.

Still preferably, in the reinforcing structure for the concrete column according to the present invention, the restricting portion is a friction portion for producing slide resistance to the overlapping portions of the plurality of steel plates.

Still preferably, in the reinforcing structure for the concrete column according to the present invention, the friction portion is a concavoconvex shape formed on at least one of opposing surfaces of the overlapping portions of the plurality of steel plates.

Still preferably, in the reinforcing structure for the concrete column according to the present invention, the restricting portion comprises: an elongated hole formed horizontally long in a slide direction in the overlapping portion of one of the steel plates; and a stopper fixed to the overlapping portion of the other of the steel plates, and being inserted into the elongated hole.

Still preferably, in the reinforcing structure for the concrete column according to the present invention, the stopper is a bolt, and friction between the one of the steel plates and the other of the steel plates is adjusted by screwing a nut into the bolt.

Still preferably, in the reinforcing structure for the concrete column according to the present invention, the plurality of steel plates are arranged in such a manner to surround the concrete column.

Still preferably, the reinforcing structure for the concrete column according to the present invention further comprises: a reinforcing steel plate fixed to a side surface of the concrete column; where the space portion is formed in between the steel plates and the concrete column with the reinforcing steel plate interposed therebetween.

Still preferably, in the reinforcing structure for the concrete column according to the present invention the reinforcing steel plate comprises: a fixed plate fixed to one side surface of the concrete column; and a pair of connecting pieces each protruding from either of the end portions of the fixed plate towards the outdoor side; and the steel plate comprises: a first steel plate arranged on one side of the reinforcing steel plate; and a second steel plate arranged on the other side of the reinforcing steel plate; and the first and second steel plates each comprise a connecting piece protruding towards an indoor side; the connecting piece of the first steel plate is connected to one of the connecting pieces of the reinforcing steel plate; the connecting piece of the second steel plate is connected to the other one of the connecting pieces of the reinforcing steel plate; and the overlapping portion is formed in each of the first and second steel plates.

Another reinforcing structure for a concrete column according to the present invention includes: a plurality of steel plates provided around the concrete column such that the plurality of steel plates surround the concrete column, wherein end portions of the adjacent steel plates slidably overlap with each other; a reinforcing sheet wound around the steel plates to bind the steel plates; and grout material filled into a space portion formed in between an outer surface of the concrete column and the steel plates, where: the reinforcing sheet is adhered to an outer surface of the steel plates, and a restricting portion is provided for restricting sliding movement of a sliding portion between the end portions of the steel plates, thereby achieving the objective described above.

Preferably, in the reinforcing structure for the concrete column according to the present invention, the restricting portion is a friction portion for producing slide resistance to the end portions of the steel plates.

Still preferably, in the reinforcing structure for the concrete column according to the present invention, the friction portion is a concavoconvex shape formed on opposing surfaces of the end portions of the steel plates.

Still preferably, in the reinforcing structure for the concrete column according to the present invention, the restricting portion includes: an elongated hole extending in a horizontal direction and formed in one of the end portions, which allows the sliding of the steel plates; and a stopper fixed to the other of the end portions, which slides with the one end portion, of the steel plates, and inserted into the elongated hole.

Still preferably, in the reinforcing structure for the concrete column according to the present invention, the stopper contacts an end surface in a longitudinal direction of the elongated hole composing the restricting portion, to restrict a slide distance in between the steel plates.

Still preferably, in the reinforcing structure for the concrete column according to the present invention, the restricting portion includes: an elongated hole provided for one of the end portions of the steel plates; and mounting hardware provided for the other of the end portions of the steel plates, the steel plates sliding with each other; and the mounting hardware includes a bolt inserted into the elongated hole; and a nut screwing into the bolt, and by the screwing of a screw portion of the bolt and the nut, a peripheral edge of the elongated hole of one of the steel plates provided on the outside is put between the nut and the other one of the steel plates to be positioned on the inside.

Still preferably, in the reinforcing structure for the concrete column according to the present invention, a transverse section of the concrete column is in a quadrilateral shape, and a transverse section of the steel plate is in an L-shape.

Still preferably, in the reinforcing structure for the concrete column according to the present invention, the reinforcing structure further includes: a reinforcing steel plate fixed to a surface on an outdoor side of the concrete column; a steel plate provided on the outside of the reinforcing steel plate; a reinforcing sheet adhered by adhesive to the outside of the steel plate; and grout material filled into a space portion formed in between the reinforcing steel plate and the steel plate; where the reinforcing steel plate includes: a fixation plate fixed to a surface on the outdoor side of the concrete column; and first connecting pieces folded towards the outdoor side from both end portions of the fixation plate; where the steel plate includes: a first steel plate provided for one of end portions of the reinforcing steel plate; and a second steel plate provided for the other one of the end portions of the reinforcing steel plate; where each of the first and second steel plates includes: an outer plate; and a second connecting piece folded from an end portion of the outer plate; where the second connecting piece of the first steel plate is connected to the one of the first connecting pieces of the reinforcing steel plate; where the second connecting piece of the second steel plate is connected to the other one of the first connecting pieces of the reinforcing steel plate; and where the end portions of the outer plates of the first and second steel plates slidably overlap with each other.

A method for reinforcing a concrete column according to the present invention includes the steps of: disposing a plurality of steel plates such that end portions of the adjacent steel plates partially overlap with each other and are slidable with each other; applying adhesive to a periphery of the steel plates; winding a reinforcing sheet around the steel plates, to which the adhesive has been applied, to bind the steel plates; and filing grout material into a space portion formed in between an outer surface of the concrete column and the steel plates, where a restricting portion for allowing for sliding movement of the slidable portions while restricting the sliding movement, thereby achieving the objective described above.

Another reinforcing structure for a concrete column with a wall according to the present invention is provided, in which the wall is provided for a side surface of the concrete column, the reinforcing structure including: a reinforcing steel plate fixed to a surface on an outdoor side of the concrete column; a steel plate provided on the outside of the reinforcing steel plate; a reinforcing sheet adhered by adhesive to the outside of the steel plate; and grout material filled into a space portion formed in between the reinforcing steel plate and the steel plate, where the reinforcing steel plate includes: a fixation plate fixed to a surface on the outdoor side of the concrete column; and first connecting pieces each folded towards the outdoor side from both end portions of the steel plate; where the steel plate includes: a first steel plate provided for one of end portions of the reinforcing steel plate; and a second steel plate provided for the other of the end portions of the reinforcing steel plate; where each of the first and second steel plates includes: an outer plate; and a second connecting piece folded from an end portion of the outer plate; where the second connecting piece of the first steel plate is connected to one of the first connecting pieces of the reinforcing steel plate;

where the second connecting piece of the second steel plate is connected to the other of the first connecting pieces of the reinforcing steel plate; and where the end portions of the outer plates of the first and second steel plates slidably overlap with each other, thereby achieving the objective described above.

Preferably, in the reinforcing structure for the concrete column with the wall according to the present invention, the reinforcing steel plate is formed in a U-shaped transverse section.

Still preferably, in the reinforcing structure for the concrete column with the wall according to the present invention, the first and second steel plates are formed in an L-shaped transverse section.

Still preferably, in the reinforcing structure for the concrete column with the wall according to the present invention, the first connecting piece of the reinforcing steel plate and the second connecting pieces of the first and second steel plates are connected with each other by a tie bar and a nut.

Still preferably, in the reinforcing structure for the concrete column with the wall according to the present invention: each of the second connecting pieces of the first and second steel plates is provided on the outside of a pair of the first connecting pieces of the reinforcing steel plate; and a metallic washer plate is provided on the outside of each of the second connecting pieces, the reinforcing sheet is interposed between the second connecting piece and the metallic washer plate, a tie bar is put between the pair of the metallic washer plates, and a nut is screwed into a screw portion formed at a tip portion of the tie bar, so that the first connecting piece of the reinforcing steel plate is connected with the second connecting piece of the steel plate, and the reinforcing sheet is held in between the second connecting piece of the steel plate and the metallic washer plate.

Still preferably, in the reinforcing structure for the concrete column with the wall according to the present invention, the reinforcing structure further includes a restricting portion provided thereto, for restricting slide movement of a sliding portion of the end portion of the steel plate.

Still preferably, in the reinforcing structure for the concrete column with the wall according to the present invention, the restricting portion is a friction portion for producing slide friction to the end portion of the steel plate.

Still preferably, in the reinforcing structure for the concrete column with the wall according to the present invention, the friction portion is a concavoconvex shape formed on opposing surfaces of the slidable end portions.

Still preferably, in the reinforcing structure for the concrete column with the wall according to the present invention, the restricting portion includes: an elongated hole extending in a horizontal direction and formed in one of the end portions, which slides; and a stopper fixed to the other of the end portions, which slides with the one end portion, and slidably inserted into the elongated hole.

Still preferably, in the reinforcing structure for the concrete column with the wall according to the present invention, the reinforcing steel plate is fixed to the concrete column by an anchor bolt.

Still preferably, in the reinforcing structure for the concrete column with the wall according to the present invention, the reinforcing steel plate is fixed to the concrete column by adhesive.

Still preferably, in the reinforcing structure for the concrete column with the wall according to the present invention, the reinforcing sheet is adhered to a surface on an indoor side of the concrete column.

Still preferably, in the reinforcing structure for the concrete column with the wall according to the present invention, a slit is formed in a wall adjacent to the concrete column, and the reinforcing sheet is adhered around the concrete column through the slit.

Still preferably, in the reinforcing structure for the concrete column with the wall according to the present invention, the steel plate is provided for a surface on an indoor side of the concrete column, a slit is formed in a wall adjacent to the concrete column, the reinforcing sheet is adhered around the concrete column through the slit, and the reinforcing sheet tighten the steel plate towards the concrete column.

Another method for reinforcing a concrete column with a wall according to the present invention is provided, in which the wall is provided for a side surface of the concrete column, the method including the steps of: fixing a reinforcing steel plate on a surface, on an outdoor side, of the concrete column; disposing an steel plate on an outside of the reinforcing steel plate; adhering a reinforcing sheet on an outside of the steel plate by adhesive; and filling grout material into a space portion formed in between the reinforcing steel plate and the steel plate; where the reinforcing steel plate includes: a fixation plate fixed to a surface on the outdoor side of the concrete column; and first connecting pieces each folded towards the outdoor side from both end portions of the fixation plate; where the steel plate includes: a first steel plate provided for one of end portions of the reinforcing steel plate; and a second steel plate provided for the other of the end portions of the reinforcing steel plate; where each of the first and second steel plates includes: an outer plate; and a second connecting piece folded from an end portion of the outer plate; where the second connecting piece of the first steel plate is connected to one of the first connecting pieces of the reinforcing steel plate; where the second connecting piece of the second steel plate is connected to the other of the first connecting pieces of the reinforcing steel plate; and where the end portions of the outer plates of the first and second steel plates slidably overlap with each other, thereby achieving the objective described above.

Advantageous Effects of Invention

According to the present invention, a plurality of steel plates are bound by a reinforcing sheet with adhesive. As a result, welding operations are not required unlike prior art, and thus fire will not break out due to sparks produced during welding operations. Furthermore, while end portions of adjacent steel plates are overlapped with each other and the end portions are normally fastened with each other, the end portions are configured to slide from each other when the shear force acts too greatly and rapidly on the steel plates. As a result, the end portions of the steel plates are not required to be butted with each other, and the construction accuracy will be stabilized. Furthermore, the size of the space portion in between the steel plates and the concrete column is changeable. Thus, even if there is an error in the outer shape of a concrete column, a space for filling grout material can be accurately secured.

When shear force acts on the concrete column, the overlapping portion of the adjacent steel plates will slide with each other and transmit the force to the reinforcing sheet. However, the sheet is with adhesive and thus the sheet strongly bonds and binds all the steel plates entirely. As a result, the obtained reinforcing structure enhances the toughness of the concrete column. Thus, the earthquake resistance of the reinforced concrete column will be greatly improved.

A restricting portion for restricting this sliding movement is provided for a portion at which the overlapping portion of the steel plates slide with each other. Thus, even if shear force acts greatly and rapidly on the concrete column, part of the force will be restricted, or the sliding distance of the overlapping portion of the steel plates will be restricted, by the restricting portion of the steel plates. As a result, not all the shear force will work on the reinforcing sheet.

That is the restricting portion together with the reinforcing sheet with adhesive, firmly binds and bonds the steel plates. Therefore, shear force due to the external force from earthquake or the like will not be directly transmitted to the sheet, which greatly prevents the reinforcing sheet from being fractured. As a result, the grout material, steel plates and reinforcing sheet reinforce the concrete column, so that the toughness and bending strength will be improved for an old reinforced concrete column, which is supposed to be weakened, and the earthquake resistance of such a reinforced concrete column will be improved tremendously.

In particular, a friction portion for producing resistance for the sliding of the end portions of the steel plates can be formed as a restricting portion. The friction portion allows the bonding between the end portions of the pair of steel plates to be maintained when shear force acts on the concrete column, while the friction portion permits sliding to occur when further shear force is applied. Moreover, friction resistance will occur to the sliding movement and force working on the reinforcing sheet will be suppressed. Throughout such series of transmission of the force, the tension of the reinforcing sheet works effectively and the earthquake resistance of the concrete column is improved.

Furthermore, when the restricting portion includes: an elongated hole extending in a horizontal direction and formed in an overlapping portion of an steel plate; and a stopper fixed at an overlapping portion of another adjacent steel plate, slidably inserted into the elongated hole, the movement of the stopper will be restricted within the elongated hole, which prevents the overlapping portions of the steel plates from being slid without limitation. As a result, the reinforcing sheet will not expand more than its allowable expansion limit. Accordingly, the cutting of the reinforcing sheet can be prevented, which prevents a building from collapsing due to large earthquakes.

Furthermore, according to another embodiment of the present invention, a reinforcing steel plate is provided which is fixed to a side surface of a concrete column; and grout material is positioned at a space portion formed in between a plurality of steel plates and the side surface of the concrete column, with the reinforcing steel plate interposed therebetween, so that the concrete column will be reinforced. Moreover, the steel plates are bound and bonded by the reinforcing sheet, with adhesive interposed therebetween, from the outer surface of the steel plates. By this structure, the toughness and bending strength will be improved, which balances the strength between the entire structure and the column earthquake resistance is improved.

Since the reinforcing structure according to the subject embodiment can be formed from one side surface of a concrete column, it is particularly effective when the concrete column exists in a tunnel or when there is a store or a house on the indoor side of the concrete column. For example, the construction can be made from the outdoor side of the concrete column without closing the store or house. Thus, the construction will not influence the store or the like located on the indoor side of the column. When a column in a tunnel is reinforced, the construction can be made from the side of the column facing the tunnel. Furthermore, the concrete column can be reinforced using relatively light steel plates. Thus, the reinforcing structure can be constructed only with manpower for concrete columns located in a tunnel or underneath elevated railway tracks, into which heavy machinery cannot be brought.

In the reinforcing structure of the concrete column according to the present invention that is reinforced as described above, a part or all of the walls, provided on the side surfaces of the concrete column of the structure, can be removed. For example, a part or all of the walls between adjacent columns can be removed to create a large interior space within the structure. This will increase the degree of freedom in designing.

DESCRIPTION OF EMBODIMENTS

Hereinafter, Embodiments of the present invention will be described in detail with reference to accompanying figures.

In the following Embodiments, reinforced concrete columns will be described. Regardless of whether concrete columns comprise rebars, iron frames or a combination thereof within the columns, the present invention can be applied, without limitation to reinforced concrete columns, to steel-frame reinforced concrete columns, steel pipe concrete columns, and steel frame columns in a similar manner.

(Embodiment 1)

FIGS. 1 to 4 show Embodiment 1.

Figure 1:
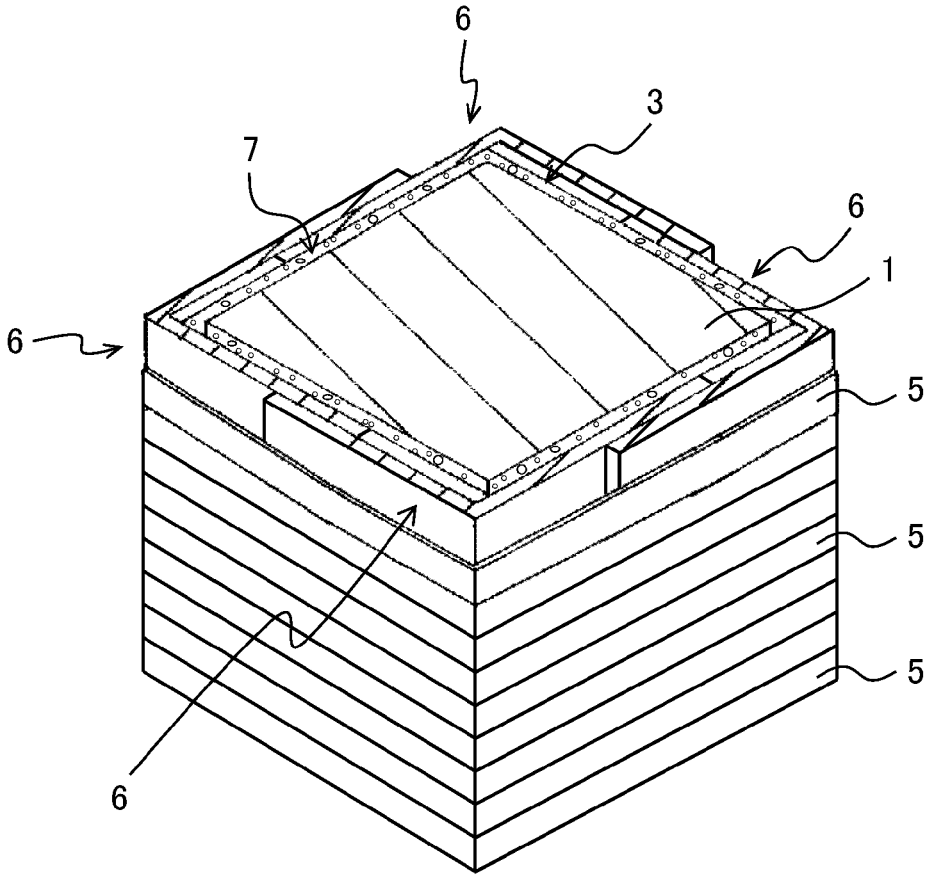
FIG. 1 is a perspective view of a reinforcing structure of a reinforced concrete column according to Embodiment 1 of the present invention.
Figure 2:
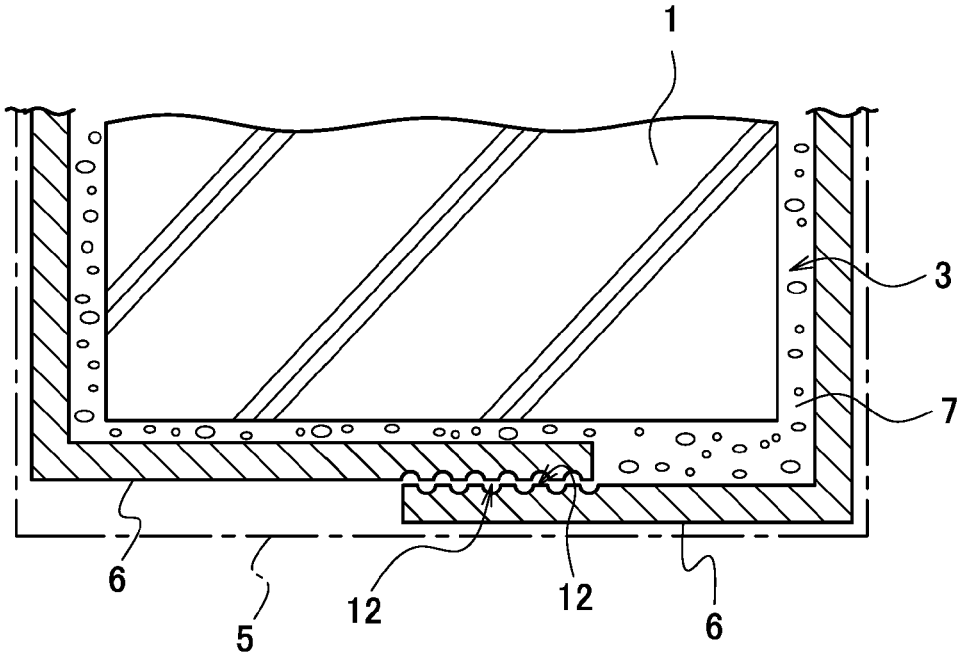
FIG. 2 is a cross sectional view of a substantial part of a reinforcing structure of a reinforced concrete column shown in FIG. 1.

As shown in FIGS. 1 and 2, four steel plates 6, of an L-shaped transverse section, are arranged around a reinforced concrete column 1, of which transverse section is formed in a quadrilateral shape, in such a manner that the steel plates 6 surround the reinforced concrete column 1. Each of the steel plates 6 is arranged in such a manner to surround each edge of the reinforced concrete column 1. An end portion (overlapping portion) of a steel plate 6 is slidably arranged overlapping another end portion (overlapping portion) of another adjacent steel plate 6. A typical size of the reinforced concrete column 1 is 600 mm×600 mm or 800 mm×800 mm.

The steel plates 6 are formed by folding a steel plate of 1.6 mm to 3.2 mm in thickness, for example, into a transverse section of an L-shape. The length of a plate-shaped portion on one side of the steel plates 6 formed into an L-shape and the length of a plate-shaped portion on the other side thereof may be the same. Alternatively, the lengths may be different from each other.

Figure 3:
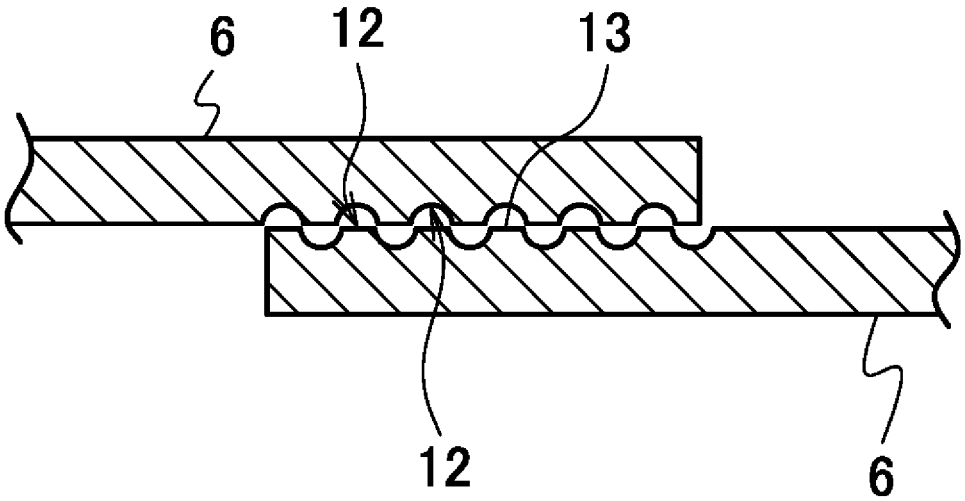
FIG. 3 is an enlarged cross sectional view of a substantial part of a reinforcing structure of a reinforced concrete column shown in FIG. 2.
Figure 4:
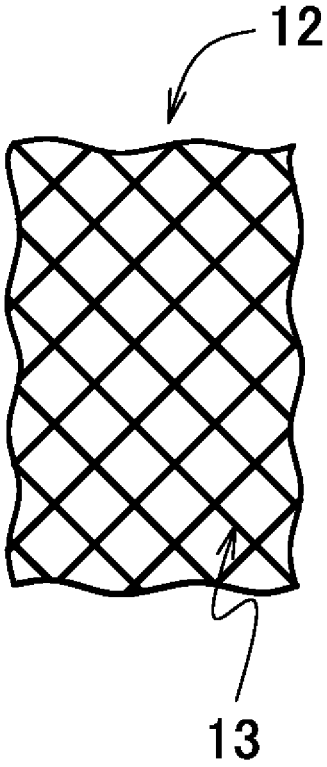
FIG. 4 is an enlarged view of a friction portion formed in a steel plate shown in FIG. 3.

A restriction portion is preferably provided for the overlapping portion of a plurality of steel plates 6, for restricting the sliding at the overlapping portion. For example, as shown in FIGS. 2 to 4, such a restricting portion may be a friction portion 12 for providing slide resistance for the overlapping portion of the plurality of steel plates 6. The width of the friction portion 12 (i.e., area of the friction portion) may be defined as needed.

The friction portion 12 may be in a concavoconvex shape provided on each opposing plate of the overlapping portions of the steel plates 6. This concavity and convexity may include convex shapes and/or concave grooves 13. For example, the friction portion 12 may be formed by providing concave grooves 13 in a lattice pattern, or by providing convex shapes in a lattice pattern, on each opposing plane of the overlapping portions of the steel plates 6, as shown in FIG. 4. Instead of the convex shapes and/or concave grooves, the friction portion 12 may also be formed by providing a large number of protruding portions on each opposing plane of the overlapping portions of the steel plates 6.

The friction portion 12 is configured to allow for relative sliding movement of the overlapping portion of a pair of steel plates 6 while producing resistance for the sliding movement when great shear force (shear force equal to or greater than a shear force that begins to cause relative sliding of the overlapping portion of a pair of steel plates) works on the reinforced concrete column 1. The slide resistance force (friction) provided by the friction portion 12 is defined in accordance with expected shear force that the reinforced concrete column 1 receives.

A reinforcing sheet 5 is adhered with adhesive to the outer surface of the steel plates 6 to bind the steel plates 6.

In a case when shear force works greatly and rapidly on the concrete column due to large earthquakes, even the structure itself according to the present invention will not be integrated as a whole if adhesive is not used to the structure, let alone to the conventional structures using fiber sheets. As a result, the structure may not necessarily have the satisfactory reinforced strength as a whole.

The reinforcing sheet 5 may be adhered using adhesive to the outer surface of the steel plates 6 in the following manner.

Adhesive is applied to the outer surface of the steel plates 6 and the reinforcing sheet 5 is adhered to the outer surface of the steel plates 6 using adhesive. As for the reinforcing sheet 5, a plurality of the reinforcing sheets having a predetermined width and also having a predetermined length, which extends in a horizontal direction, may be used and they may be adhered on top of one another for a plurality of stages on the outer surface of the steel plates 6. For example, a plurality of sheets, which are slightly longer than an outer circumference of the plurality of steel plates 6 shown in FIG. 1, may be used and the plurality of sheets may be adhered on top of one another for a plurality of layers on the outer surface of the steel plates 6. Alternatively, a continuous reinforcing sheet 5 of the length of wrapping a plurality of the steel plates 6 for several times may be used and the reinforcing sheet 5 may be wound from the top to the bottom of the reinforced concrete column 1. As such, typically, a planar sheet is formed by the reinforcing sheet 5, covering the entire surface of the steel plates 6. The reinforcing sheet 5 may be adhered, not to the entire surface of the steel plates 6, but to a part of the surrounding area of the steel plates 6.

The reinforcing sheet 5 may be prepared from a belt-shaped fiber sheet consisting of a large number of fibers extending in one direction Alternatively, the reinforcing sheet 5 may be formed from a belt-shaped fiber sheet in which synthetic resin with excellent elasticity and strength is impregnated.

The fiber to be used may be carbon fiber, glass fiber, aramid fiber, polyethylene fiber and the like. The synthetic resin to be used may be polyurea, epoxy resin, polyurethane, polyester and the like. Polyurea is preferable since it is excellent in toughness. Polyester, for example, is preferable in terms of biodegradable disposable resin. These types of synthetic resin may be applied to or sprayed on the reinforcing sheet and/or the outer surface of the steel plates 6 using brush, roller, spray or the like. Normally, synthetic resin will be cured after the reinforcing sheet 5 is adhered.

As to the adhesive described above, publicly known adhesive may be used such as epoxy adhesive, methacryl adhesive, and acrylic adhesive.

As such, the reinforcing sheet 5 with adhesive is wound around the plurality of steel plates 6, and the plurality of steel plates 6 are bound thereby. A space portion 3 is formed in between the outer surface of the reinforced concrete column 1 and the steel plates 6, as shown in FIG. 1. An overlapping portion of a steel plate 6 is slidably joined with another overlapping portion of an adjacent steel plate 6, so that a substantially constant space is created in between the steel plates 6 and the reinforced concrete column 1. Grout material 7 is filled into the space portion 3. The steel plates 6 will be integrated with the reinforced concrete column 1 by the grout material 7 filled into the space portion 3.

Next, a method for reinforcing a reinforced concrete column will be described.

As shown in FIGS. 1 and 2, four steel plates 6 are disposed around a reinforced concrete column 1 in such a manner to surround the reinforced concrete column 1. In this regard, the steel plates 6 are arranged around the reinforced concrete column 1 so that the space portion 3 will be formed in between the outer surface of the reinforced concrete column 1 and the steel plates 6. The overlapping portions of the adjacent steel plates 6 overlap with each other. The overlapping portion of the steel plate 6 is slid to the adjacent overlapping portion of the other steel plate 6 so that the space of the space portion 3 will be substantially constant in between the steel plates 6 and the reinforced concrete column 1.

Next, adhesive is applied to the outer surface of each of the steel plates 6, and a single, or double or more, reinforcing sheet 5 of a predetermined length is adhered to the outer surface of the four steel plates 6 to form a planar sheet for covering all the surfaces of the steel plates 6.

The grout material 7 is filled into the space portion 3, which has been formed in between the reinforced concrete column 1 and the steel plates 6, and the grout material 7 is solidified. Thus, the steel plates 6 are fixed to the reinforced concrete column 1.

In order to inject the grout material 7 into the space portion 3, an inlet may be created at a part of the steel plates 6 and the reinforcing sheet 5, and the grout material 7 may be inject into the space portion 3 through the inlet using a hose or the like.

In such a method for reinforcing the reinforced concrete column 1, the steel plates 6 are integrated with the reinforced concrete column 1 by the grout material 7 filled in between the reinforced concrete column 1 and the steel plates 6, thereby improving the strength of the reinforced concrete column 1. Furthermore, since the steel plates 6 slide with each other, force is transmitted to the reinforcing sheet 5. In addition, the sheet 5 with adhesive bonds and binds the steel plates 6. Accordingly, this increases toughness compared to a reinforcing structure where steel plates are bound without adhering a reinforcing sheet.

When a pair of steel plates 6 slide with each other, the friction portions 12 provided for the steel plates 6 produce resistance to the sliding movement, thereby improving shear capacity of the reinforced concrete column 1. By increasing or reducing the number of winding of the reinforcing sheet 5 wound around the steel plates 6, the reinforced strength of the reinforced concrete column 1 can be adjusted.

In this embodiment, a case has been described where a restricting portion is provided for the overlapping portions of a plurality of steel plates 6, for restricting the slide at the overlapping portions. However, the present invention also includes a case where the restricting portion is not provided for the overlapping portions.

(Embodiment 2)

Figure 5:
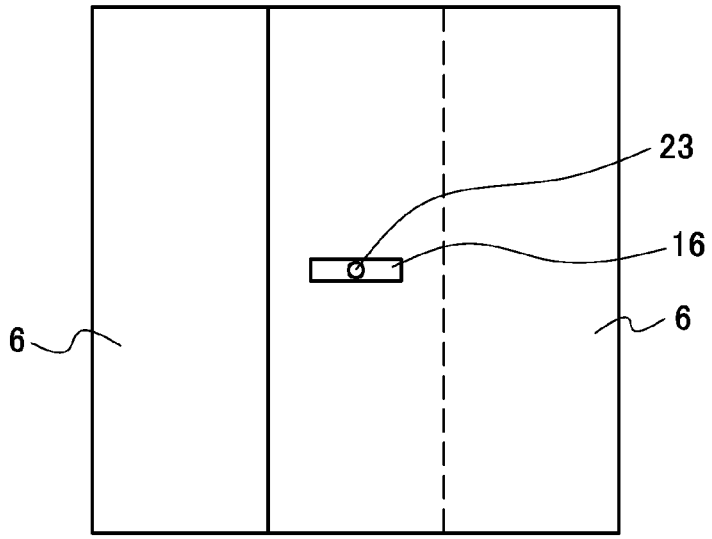
FIG. 5 is an elevation view of a reinforcing structure of a reinforced concrete column according to Embodiment 2 of the present invention.
Figure 6:
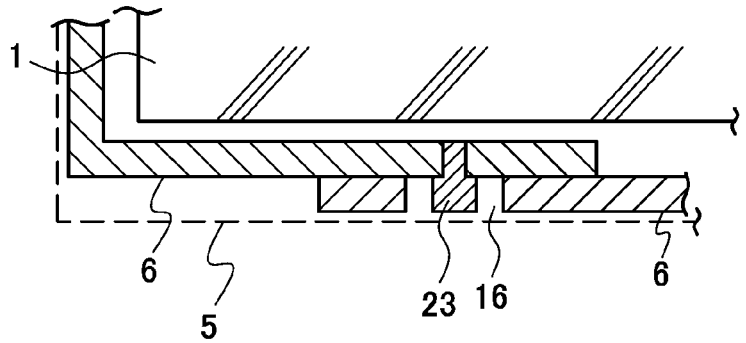
FIG. 6 is an enlarged cross sectional view of a substantial part of a reinforcing structure of a reinforced concrete column shown in FIG. 5.

FIGS. 5 and 6 show Embodiment 2.

According to Embodiment 2, the restricting portion for restricting a slide comprises: an elongated hole 16 extending in a horizontal direction and formed in an overlapping portion of one steel plate 6; and a stopper 23 fixed to an overlapping portion of another adjacent steel plate 6, as shown in FIGS. 5 and 6. The stopper 23 protrudes from a surface of the steel plate 6 and is inserted into the elongated hole 16. The remaining configurations other than the restricting portion are the same as those according to Embodiment 1.

The stopper 23 is fixed to the overlapping portion of the steel plate 6 disposed on the inside by welding, screwing or the like. The outer diameter of the stopper 23 is defined to be smaller than the size of the minor axis of the elongated hole 16, and the stopper 23 is movable in the horizontal direction within the elongated hole 16. The slidable distance of the stopper 23 is defined to be within the limit at which the reinforcing sheet 5 is cut off by tension.

When the adjacent steel plates 6 relatively slide for a predetermined distance or more, the stopper 23 hits the end surfaces of the elongated hole 16. Thus, the sliding movement of the steel plate 6 will be restricted.

According to Embodiment 2, the slidable distance by the steel plate 6 is restricted within the travel distance of the stopper 23, which is particularly effective when unexpected strength of shear force works on the reinforced concrete column 1. Specifically, the relative sliding movement within the predetermined distance by the corresponding pair of steel plates 6 (external steel plate 6 and internal steel plate 6) is allowed, but no sliding movement is allowed beyond the defined distance. Thus, even if unexpected strength of shear force is applied to the reinforced concrete column 1, the movement of the steel plates 6 is regulated before the reinforcing sheet 5 is fractured, thereby preventing a situation where the reinforcing sheet 5 is fractured and the reinforced concrete column 1 is destroyed, from happening.

Since the outer steel plate 6 only includes the elongated hole 16 for allowing the stopper 23 to be inserted through, formed therein, the steel plate 6 can also be prevented from reducing its strength.

On the contrary to the above-described configuration, an elongated hole extending in the horizontal direction may be provided for the overlapping portion of the steel plate 6 disposed on the inside, and a stopper to be inserted into the elongated hole may be provided for the overlapping portion of the steel plate 6 that is disposed on the outside.

(Embodiment 3)

Figure 7:
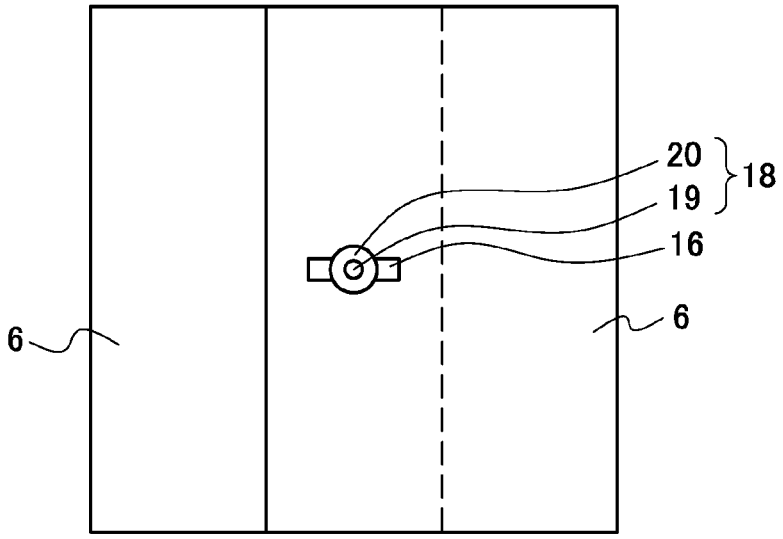
FIG. 7 is an elevation view of a reinforcing structure of a reinforced concrete column according to Embodiment 3 of the present invention.
Figure 8:
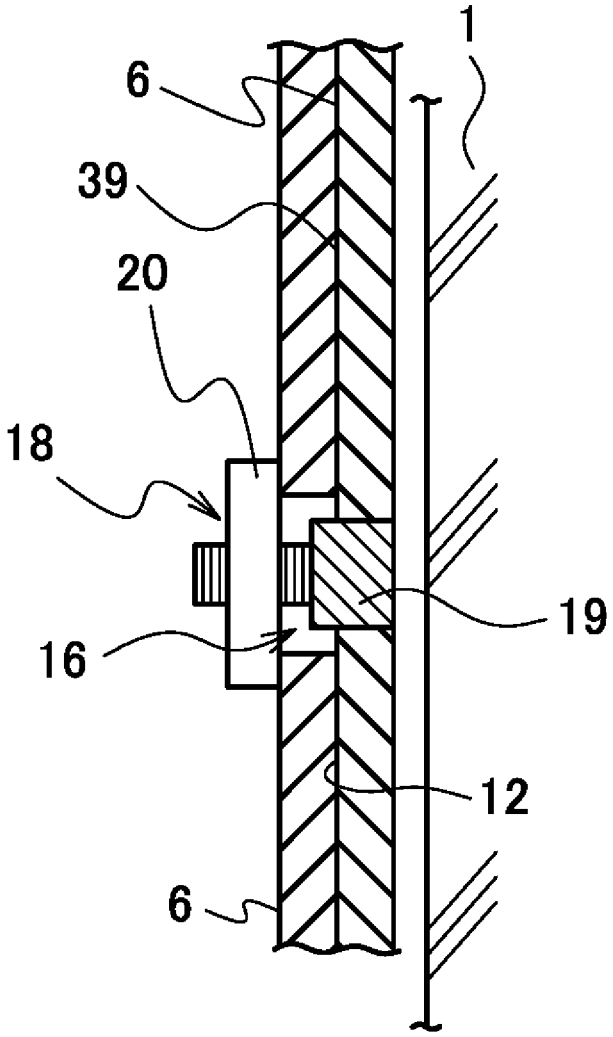
FIG. 8 is an enlarged cross sectional view of a substantial part of a reinforcing structure of a reinforced concrete column shown in FIG. 7.

FIGS. 7 and 8 show Embodiment 3.

According to Embodiment 3, the concepts of a friction portion and restriction of movement within an elongated hole are combined with each other. The remaining configurations other than the restricting portion are the same as those according to Embodiment 1.

Instead of the stopper shown in FIGS. 5 and 6, a bolt 19 is fixed to the overlapping portion of the steel plate 6 disposed on the inside, as shown in FIGS. 7 and 8.

A screw portion of the bolt 19 is put through an elongated hole 16, and a nut 20 is screwed into the screw portion at the tip of the bolt 19, which passes through the elongated hole 16. By turning the nut 20, the steel plate 6 positioned on the outside is pressed against the steel plate 6 placed on the inside. By changing the fastening force by the nut 20, friction is adjusted which is caused on a contacting surface 39 between the internal steel plate 6 and the external steel plate 6.

The mounting hardware 18 is composed of: a bolt 19 fixed to an internal steel plate 6; and a nut 20 screwed into a screw portion of the bolt 19. In order to smoothen the rotation of the nut 20, a washer or sleeve may be provided in between the nut 20 and the steel plate 6.

As such, the nut 20 is screwed into the screw portion of the bolt 19, protruding towards the outside of the externally arranged steel plate 6, so that the slide resistance force in between the two steel plates 6 can be adjusted from the outside of the steel plates 6. Since the movement of the bolt 19 is restricted within the elongated hole 16, the bolt 19 also functions as a stopper.

(Embodiment 4)

Figure 9:
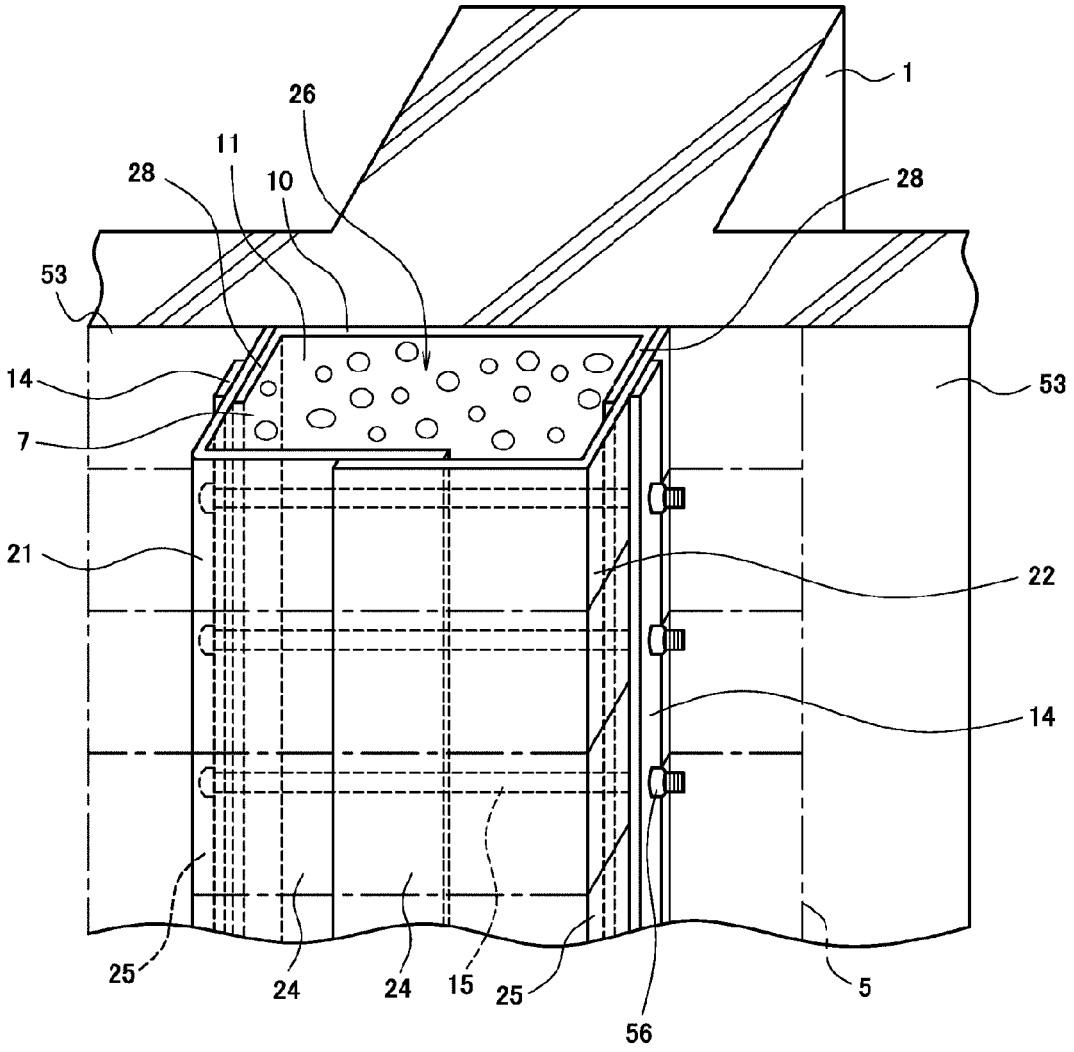
FIG. 9 is a perspective view of a reinforcing structure of a reinforced concrete column according to Embodiment 4 of the present invention.
Figure 10:
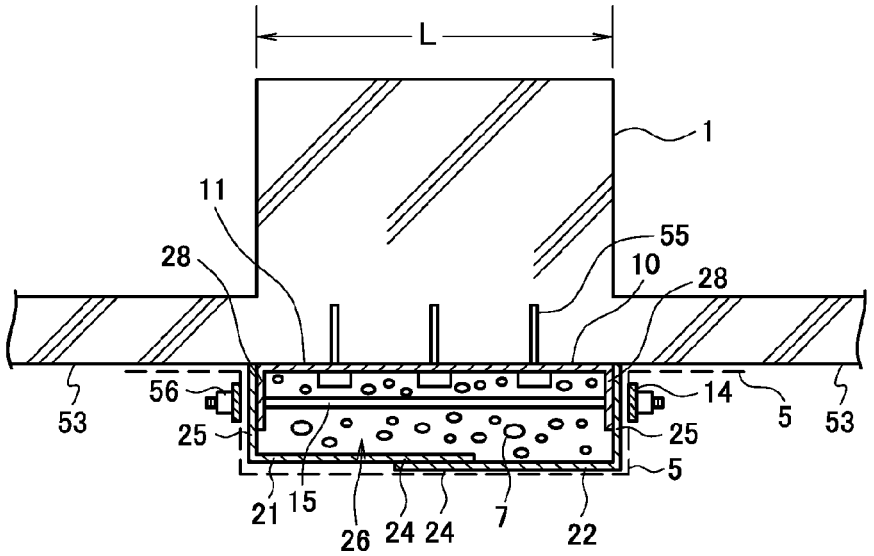
FIG. 10 is a cross sectional view of a reinforcing structure of a reinforced concrete column shown in FIG. 9.

FIGS. 9 and 10 show a reinforcing structure of a reinforced concrete column with a wall attached thereto according to Embodiment 4.

In Embodiment 4, walls 53 and 53 are respectively formed from opposing side surfaces of a reinforced concrete column 1, of which transverse section is formed in a quadrilateral shape. A store or the like is built within a space portion next to the walls 53 on the side where the reinforced concrete column 1 exists. A typical size of the reinforced concrete column 1 is 600 mm×600 mm or 800 mm×800 mm.

In this case, a reinforcing steel plate 10 is fixed to a surface, on the outdoor side of the reinforced concrete column 1.

An example of the thickness of the reinforcing steel plate 10 ranges from 1.6 mm to 3.2 mm.

The reinforcing steel plate 10 comprises: a fixation plate 11 fixed to a surface on the outdoor side of the reinforced concrete column 1; and a pair of connecting pieces 28 and 28 protruded from both end portions of the fixation plate 11 towards the outdoor side. The reinforcing steel plate 10 is preferably formed into a U-shaped transverse section by folding a steel plate.

The width of the fixation plate 11 is substantially equal to the width L of the reinforced concrete column 1, or the width is defined to be slightly longer than the width L of the reinforced concrete column 1.

A plurality of steel plates for forming a space portion in between the reinforced concrete column 1 and themselves have a first steel plate 21 arranged on one side of the reinforcing steel plate 10, and a second steel plate 22 arranged on the other side of the reinforcing steel plate 10.

An example of the thickness of the first and second steel plates 21 and 22 ranges from 1.6 mm to 3.2 mm. Each of the steel plates 21 and 22 comprises an outer plate 24 and a connecting piece 25, which is protruded from the end portion of the outer plate 24 towards the indoor side. The first and second steel plates 21 and 22 are preferably formed into an L-shaped transverse section by folding the steel plate.

As shown in FIG. 10, the fixation plate 11 of the reinforcing steel plate 10 is fixed, by an anchor bolt 55 or the like, to the surface of the reinforced concrete column 1 on the side closer to the outdoor. A plurality of anchor bolts 55 may be used. The length of the anchor bolt 55 may suitably be defined as close to the thickness of a wall 53.

Fluid, curable resin or cement mortar may be filled into and solidified in the hole through which the anchor bolt 55 is inserted, to bury the anchor bolt 55 in, and to be integrated with, the wall surface.

A connecting piece 25 of the first steel plate 21 is arranged on the outside of one of connecting pieces 28 of the reinforcing steel plate 10, and a connecting piece 25 of a second steel plate 22 is arranged on the outside of the other of the connecting pieces 28 of the reinforcing steel plate 10. In this state, the end portion (overlapping portion) of the outer plate 24 of the first steel plate 21 slidably overlaps with the end portion (overlapping portion) of the outer plate 24 of the second steel plate 22.

When the first and second steel plates 21 and 22 are connected to the outside of the reinforcing steel plate 10, a space portion 26 with a cross section of a quadrilateral shape is formed in between the outer surface of the reinforcing steel plate 10 and a pair of the first and second steel plates 21 and 22. Specifically, the space portion 26 is formed in between the steel plates 21 and 22 and the reinforced concrete column 1 with the reinforcing steel plate 10 interposed therebetween. The reinforcing sheet 5 is adhered by adhesive on the outside of the first and second steel plates 21 and 22. The grout material 7 is filled into the space portion 26. With the grout material 7 filled into the space portion 26, the first and second steel plates 21 and 22 are integrated with the reinforced concrete column 1 with the reinforcing steel plate 10 interposed therebetween.

In a case where a column is reinforced in a tunnel, it should be noted that one side surface of the reinforced concrete column 1 refers to a surface of the column on the internal side of the tunnel.

The adhesion of the reinforcing sheet 5 by adhesive to the outer surface of the first and second steel plates 21 and 22 may be performed in the following manner.

Adhesive is applied to the outer surface of the first and second steel plates 21 and 22, and the reinforcing sheet 5 is adhered to the outside of the steel plates 21 and 22 using adhesive. It is favorable to adhere the reinforcing sheet 5 by extending it from the outer surface of the steel plates 21 and 22 to the wall surface as shown in FIGS. 9 and 10.

For the reinforcing sheet 5, a sheet having a predetermined width and having a predetermined length in the horizontal direction may be used. In that case, a plurality of reinforcing sheets 5 extending in the horizontal direction may be provided and adhered one on top of the other on the outer surface of the first and second steel plates 21 and 22, as shown in FIG. 9. As such, a planar sheet is formed by the reinforcing sheet 5, covering the entire surface of the plurality of steel plates. The reinforcing sheet 5 may be adhered, not to the entire surface of the steel plates, but to a part of the surrounding area of the steel plates.

For the reinforcing sheet 5, the belt-shaped fiber sheet described in Embodiment 1 may be used. As to the adhesive described above, publicly known adhesive may be used, such as epoxy adhesive, methacryl adhesive, and acrylic adhesive, described in Embodiment 1.

Vertically elongated washer plates 14 and 14 are arranged on the outside of respective connecting pieces 25 and 25 of the first and second steel plates 21 and 22, in such a manner to cover the reinforcing sheet 5. The first and second steel plates 21 and 22 are connected with a reinforcing steel plate 10 by a tie bar 15 passing through the washer plates 14 and 14 and a nut 56. Specifically, the tie bar 15 is put through a through-hole formed in the washer plates 14, through a through-hole formed in the connecting pieces 25 and 25 of the first and second steel plates 21 and 22, and through a through-hole formed in the connecting piece 28 of the reinforcing steel plate 10. The nut 56 is screwed into the screw portion of the tie bar 15. As a result, the connecting piece 28 of the reinforcing steel plate 10 is connected with the connecting pieces 25 of the first and second steel plates 21 and 22. As for the length of the connecting piece 28 of the reinforcing steel plate 10 in the outdoor direction, any length may be set so long as the first and second steel plates 21 and 22 are connected to the reinforcing steel plate 10.

The reinforcing sheet 5 is held in between the metallic washer plate 14 and the connecting piece 25 of the first and second steel plates 21 and 22.

A fixture may be formed for fixing the first and second steel plates 21 and 22 to the reinforcing steel plate 10, with the washer plates 14, tie bar 15, and nut 56 that may be screwed into the screw portions formed on both end portions of the tie bar 15.

Next, a method for reinforcing a reinforced concrete column with a wall will be described.

As shown in FIGS. 9 and 10, the reinforcing steel plate 10 is fixed, by an anchor bolt 55 or the like, to one side surface, for example on the outdoor side, of the reinforced concrete column 1. Since the reinforcing steel plate 10 is too heavy for manpower to carry, and in consideration of the construction characteristics, it is possible to use reinforcing steel plates that are divided into a plurality of pieces. A pair of connecting pieces 28 and 28 of the reinforcing steel plate 10 are to protrude towards the outdoor side.

Next, the first and second steel plates 21 and 22 are arranged to the reinforcing steel plate 10 on the side closer to the outdoor, and each of the connecting pieces 25 of the first and second steel plates 21 and 22 are disposed on the outside of each of the connecting pieces 28 of the reinforcing steel plate 10. A space portion 26 is formed in between the reinforcing steel plate 10 and the first and second steel plates 21 and 22. The end portions of respective outer plates 24 and 24 of the first and second steel plates 21 and 22 overlap with each other.

Next, adhesive is applied to the outer surface of the first and second steel plates 21 and 22, and a single, or double or more, reinforcing sheet 5 is adhered to the outer surface of the first and second steel plates 21 and 22. When a reinforcing sheet 5 of a predetermined width is used, a plurality of reinforcing sheets 5 extending in the traverse direction are adhered on top of one another on the outer surface of the first and second steel plates 21 and 22, as shown in FIG. 9.

Thereafter, the metallic washer plates 14 extending in the longitudinal direction are provided on the outside of the connecting pieces 25 of the first and second steel plates 21 and 22 in such a manner to hold both end portions of the reinforcing sheet 5 from the outside. Next, the tie bar 15 is put through the metallic washer plates 14 provided on the left and right, and the nuts 56 are screwed into the screw portions formed at the tip portions of the tie bar 15.

Through the operations, the first and second steel plates 21 and 22 are fixed to the reinforced concrete column 1 through the reinforcing steel plate 10, and the reinforcing sheet 5 strongly tighten the outer surface of the first and second steel plates 21 and 22. When the reinforcing sheet 5 is adhered to the wall surface, adhesive is applied in advance to the wall surface.

Next, grout material 7 is filled into a space portion 26, formed in between the reinforcing steel plate 10 and the first and second steel plates 21 and 22, and the grout material 7 is solidified to integrate the reinforcing steel plate 10 and the first and second steel plates 21 and 22.

By the method for reinforcing a reinforced concrete column with a wall as described above, the grout material 7 is filled into the space portion 26 in between the concrete column surface and the first and second steel plates 21 and 22 with the reinforcing steel plate 10 interposed therebetween, so that the first and second steel plates 21 and 22 and the reinforcing steel plate 10 are integrated with the reinforced concrete column 1, which improves the strength and the toughness of the reinforced concrete column 1. When shear force works on the reinforced concrete column 1, the first and second steel plates 21 and 22 will mutually slide so that the force will be transmitted to the reinforcing sheet 5. Accordingly, the toughness will be increased, and as a result, the shear capacity of reinforced concrete column 1 will be improved. The reinforced strength of the reinforced concrete column 1 can be adjusted by increasing or decreasing the number of windings of the reinforcing sheet 5 wound around the steel plates 21 and 22.

A restricting portion for restricting the sliding movement of the overlapping portion of the first and second steel plates 21 and 22 may be formed at the overlapping portion of the first and second steel plates 21 and 22, as discussed in above Embodiment 1.

For example, as shown in FIGS. 3 and 4, a friction portion 12 may be formed, as a restricting portion, on each of opposing surface of the overlapping portions of outer plates 24 of the first and second steel plates 21 and 22.

Furthermore, as shown in FIGS. 5 and 6, the restricting portion may comprise: an elongated hole 16 extending in a horizontal direction and formed in an outer plate 24 of one of the steel plates (e.g., second steel plate 22); and a stopper 23 fixed to an outer plate 24 of the other steel plate 21 (e.g., first steel plate 21), the stopper 23 being inserted into the elongated hole 16.

Contrary to the above configuration, the restricting portion may be composed of: an elongated hole extending horizontally in a sliding direction towards an outer plate 24 of an internally arranged first steel plate 21; and a stopper fixed to an outer plate 24 of an externally arranged second steel plate 22 and being inserted into the elongated hole.

Furthermore, as shown in FIGS. 7 and 8, instead of the above stopper, a bolt and a nut may be used. In that case, a bolt 19 is fixed to an outer plate 24 of a first steel plate 21 or an outer plate 24 of a second steel plate 22; and an elongated hole 16, through which a screw portion of the bolt 19 passes, is formed in the second steel plate 22 or the first steel plate 21. A nut 20 is screwed into the screw portion of the bolt 19 which passes through the elongated hole 16.

(Embodiment 5)

Figure 11:
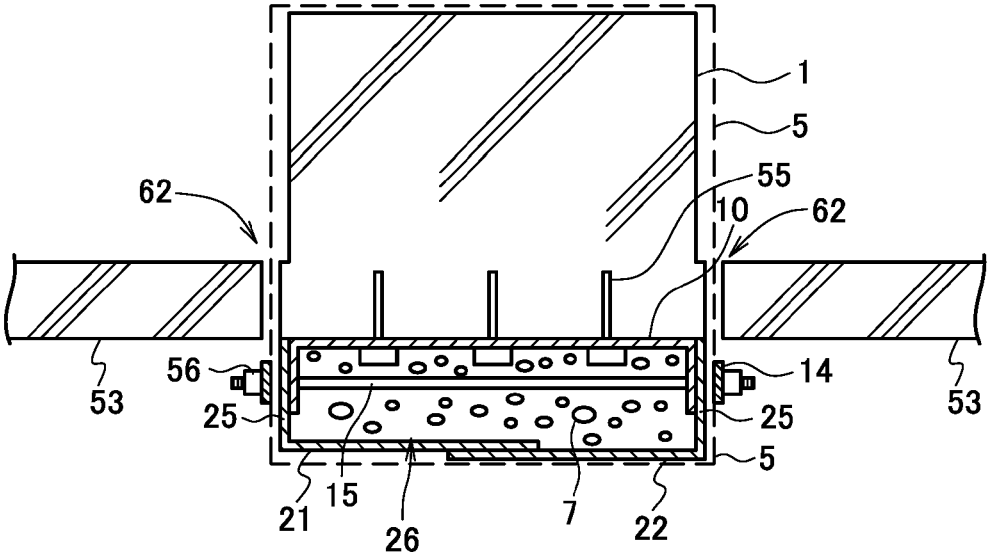
FIG. 11 is a cross sectional view of a reinforced structure of a reinforced concrete column according to Embodiment 5 of the present invention.

FIG. 11 shows Embodiment 5.

In Embodiment 5, a slit 62 for allowing communication with the inside and outside is made in a wall 53 adjacent to a reinforced concrete column 1, and a reinforcing sheet 5 is wound around the reinforced concrete column 1 and the steel plates 21 and 22 through the slit 62, followed by adhering using adhesive. According to this configuration, construction can be made in such a manner to wind a continuous reinforcing sheet 5 around the reinforced concrete column 1 and first and second steel plates 21 and 22, thereby increasing the toughness of the reinforced concrete column 1 by the reinforcing sheet 5 and also improving the construction characteristics.

By using a reinforcing sheet 5 that is long enough to wrap the reinforced concrete column 1 and the steel plates 21 and 22 several times, it is also possible to wind the reinforcing sheet 5 from the top to the bottom of the reinforced concrete column 1. The reinforcing sheet 5 winds round and round the reinforced concrete column 1 and the steel plates 21 and 22, thereby further improving the toughness of the reinforced concrete column 1.

In order to wind the reinforcing sheet 5 around the reinforced concrete column 1 and the first and second steel plates 21 and 22, adhesive is applied on the outer surface of the reinforced concrete column 1 and/or the outer surface of the first and second steel plates 21 and 22. Thereafter, the reinforcing sheet 5 is adhered to the outer surface of the first and second steel plates 21 and 22 and the reinforced concrete column 1 using adhesive. Thereafter, as discussed in Embodiment 4, the reinforcing sheet 5 is fixed to the first and second steel plates 21 and 22 by the metallic washer plate 14, tie bar 15, and nut 56.

(Embodiment 6)

Figure 12:
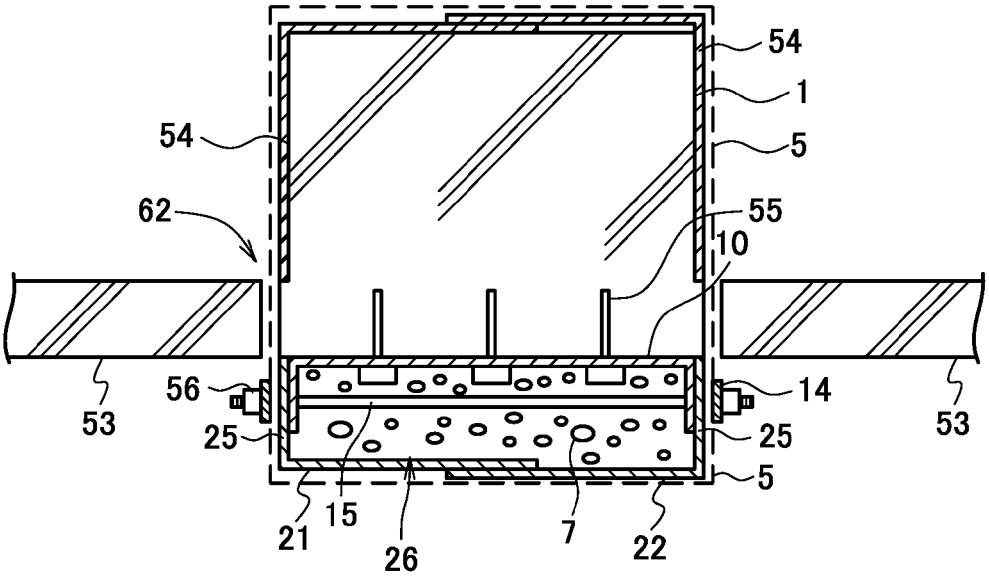
FIG. 12 is a cross sectional view of a reinforced structure of a reinforced concrete column according to Embodiment 6 of the present invention.

FIG. 12 shows Embodiment 6.

In Embodiment 6, the configuration of Embodiment 5 shown in FIG. 11 is used on the surface on the outdoor side of the reinforced concrete column 1. A pair of steel plates 54 and 54 of an L-shaped transverse section may be disposed on a surface of the indoor side of a reinforced concrete column 1. A reinforcing sheet 5 is wound on the outside of the steel plates 54 and 54 as in above Embodiment 5.

Each of the steel plates 54 is arranged in such a manner to surround the corner portions of the indoor side of the reinforced concrete column 1. The end portion of one of the steel plates 54 on the indoor side overlaps with the end portion of the other adjacent one of the steel plates 54 on the indoor side. The restricting portion discussed in Embodiments 1 to 3 (FIGS. 1 to 8), for restricting the sliding movement of the overlapping portions of the steel plates, may be provided for the overlapping portion of the steel plates 54.

In Embodiment 6, the surface on the outdoor side of the reinforced concrete column 1 with a wall attached thereto can be reinforced by a reinforcing steel plate 10, steel plates 21 and 22, grout material 7, and reinforcing sheet 5. In addition, the surface on the indoor side of the reinforced concrete column 1 with a wall attached thereto can be reinforced by steel plates 54 and a reinforcing sheet 5.

(Embodiment 7)

Figure 13:
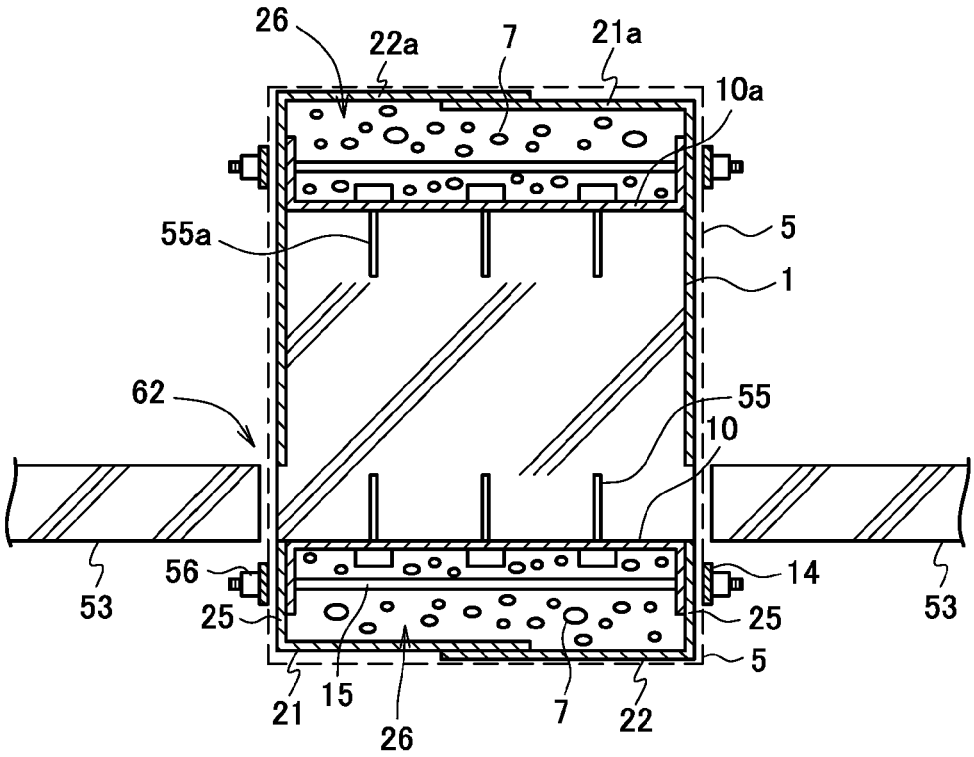
FIG. 13 is a cross sectional view of a reinforced structure of a reinforced concrete column according to Embodiment 7 of the present invention.

FIG. 13 shows Embodiment 7.

In Embodiment 7, the configuration of Embodiment 5 shown in FIG. 11 is used on the surface on the outdoor side of the reinforced concrete column 1. A reinforcing structure having a configuration similar to those shown in FIGS. 11 and 12 may be provided for the surface on the indoor side of the reinforced concrete column 1 with a wall attached thereto.

Specifically, a reinforcing steel plate 10*a* is fixed by an anchor bolt 55*a* to the surface on the indoor side of the reinforced concrete column 1 with a wall attached thereto, and first and second steel plates 21*a* and 22*a* are fixed to the reinforcing steel plate 10*a* by a metallic washer plate, a tie bar, a nut and the like. The reinforcing sheet 5 with adhesive is wound and tightened around the outer circumference of the column 1, first and second steel plates 21, 21*a*, 22 and 22*a*; and grout material 7 is filled into space portions 26 and 26 formed in between the reinforcing steel plates 10 and 10*a* and the first and second steel plates 21, 21*a*, 22 and 22*a*.

According to the present configuration, the reinforcing effects of Embodiments 5 and 6 shown in FIGS. 11 and 12 can be achieved on both the outdoor side and indoor side of the reinforced concrete column 1.

(Embodiment 8)

Figure 14:
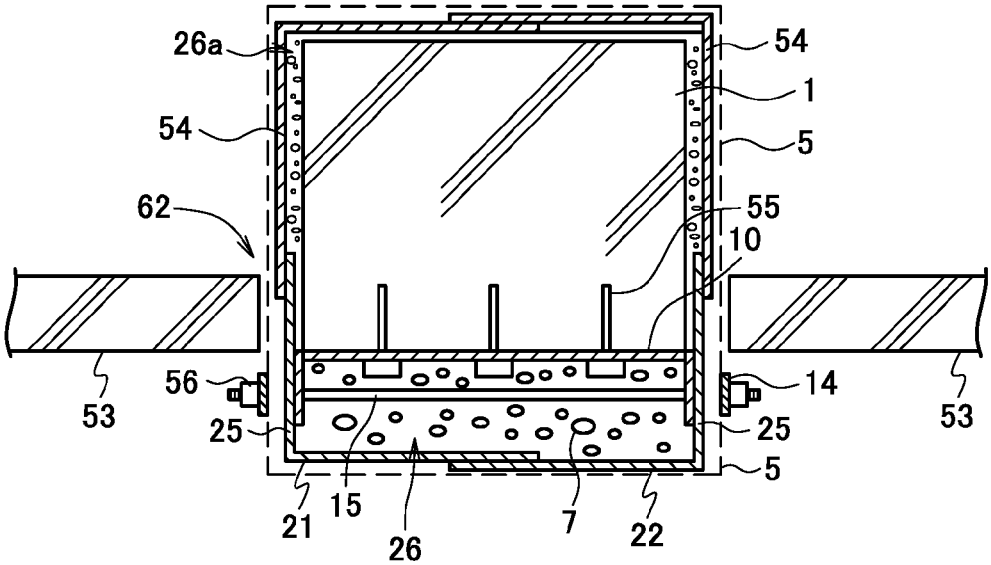
FIG. 14 is a cross sectional view of a reinforced structure of a reinforced concrete column according to Embodiment 8 of the present invention.
Figure 15:
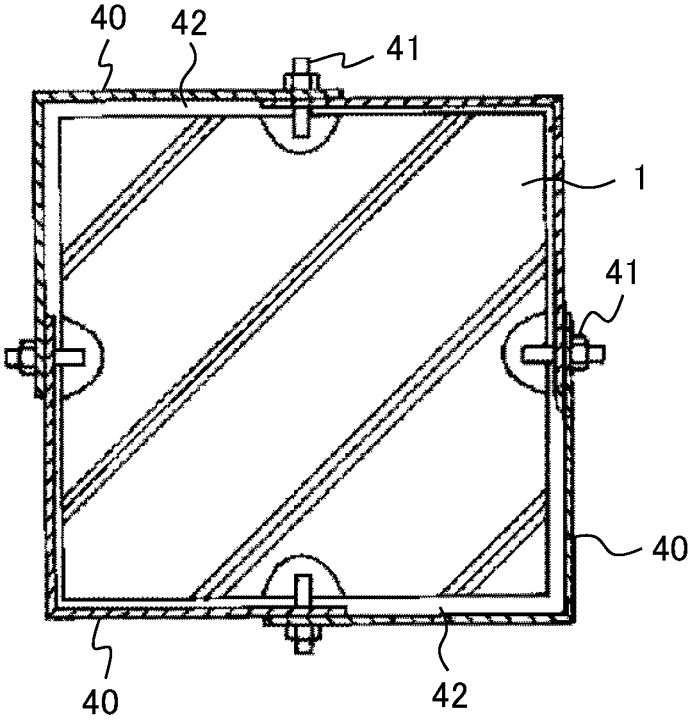
FIG. 15 is a cross sectional view of a reinforcing structure of a conventional reinforced concrete column.
Figure 16:
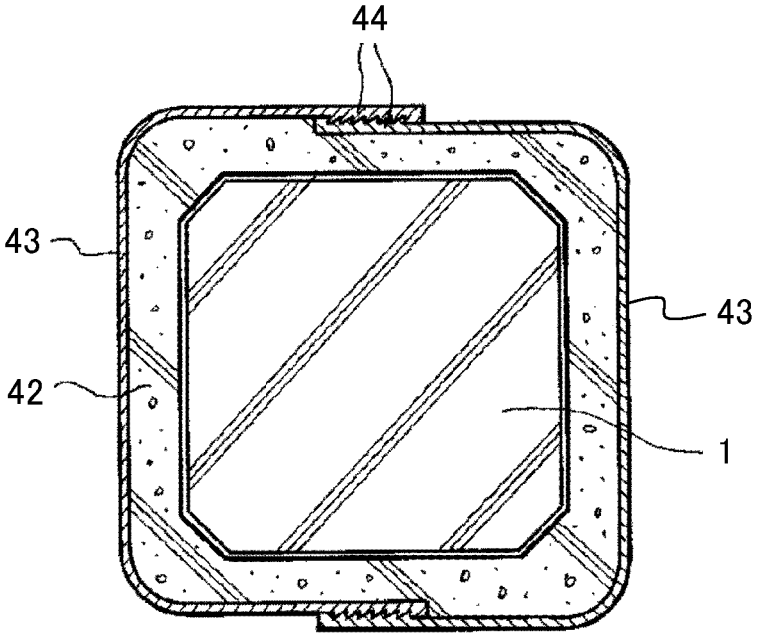
FIG. 16 is a cross sectional view of a reinforcing structure of another conventional reinforced concrete column.
Figure 17:
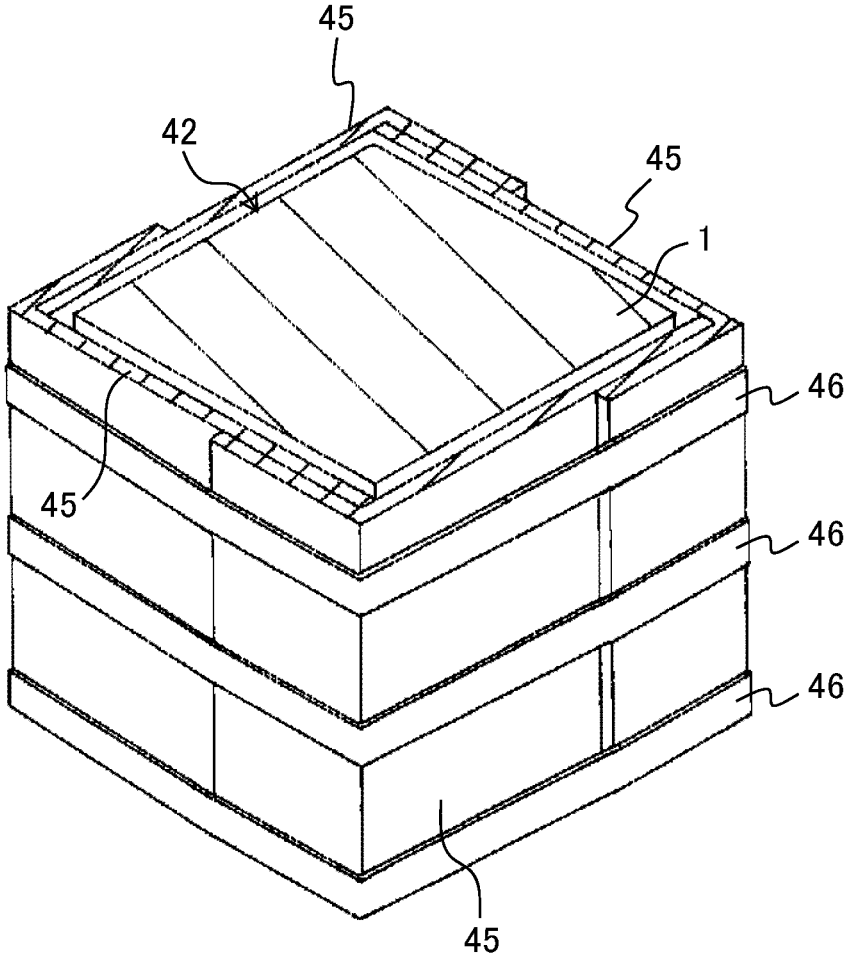
FIG. 17 is a cross sectional view of a reinforcing structure of still another conventional reinforced concrete column.
Figure 18:
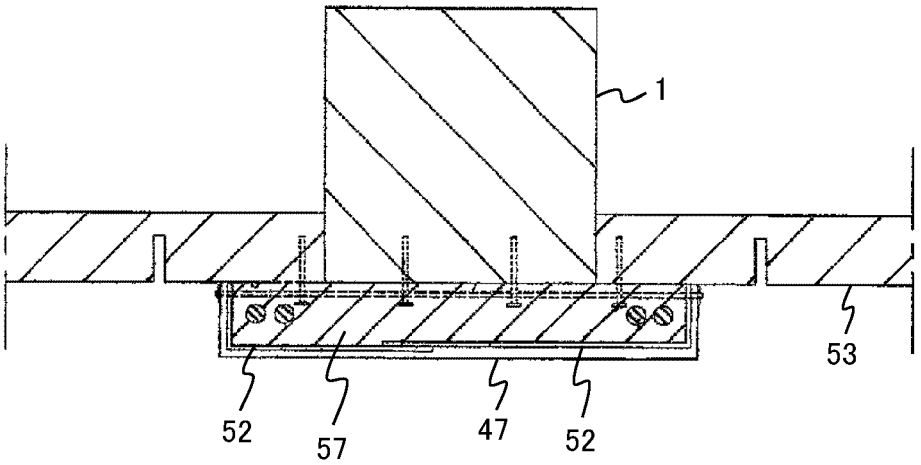
FIG. 18 is a cross sectional view of a reinforcing structure of a conventional reinforced concrete column with a wall.

FIG. 14 shows Embodiment 8.

In Embodiment 8, the configuration of Embodiment 5 shown in FIG. 11 is applied to the surface on the outdoor side of the reinforced concrete column 1; and a pair of steel plates 54 and 54 of an L-shaped transverse section are arranged on the surface on the indoor side of the reinforced concrete column 1. The steel plates 54 are arranged in such a manner to surround the corner portions on the indoor side of the reinforced concrete column 1. The end portion on the indoor side of one of the steel plates 54 overlaps the end portion on the indoor side of the other adjacent one of the steel plates 54.

A reinforcing steel plate 10 is fixed to the surface on the outdoor side of the reinforced concrete column 1; first and second steel plates 21 and 22 are connected to the outside of the reinforcing steel plate 10; and a space portion 26 is formed in between the reinforcing steel plate 10 and the first and second steel plates 21 and 22.

Connecting pieces 25 and 25 of the first and second steel plates 21 and 22 are extended towards the indoor side, and the connecting pieces 25 of the first and second steel plates 21 and 22 slidably overlap with the end portion of the steel plate 54 extending towards the outdoor side.

A reinforcing sheet 5 is wound on the outer circumference of the steel plates 54 and the first and second steel plates 21 and 22, which are adhered by adhesive.

A space portion 26*a* is formed in between the steel plate 54 and the reinforced concrete column 1, and grout material is filled into the space portion 26*a*.

The above-mentioned restricting portion may be provided for the overlapping end portions of the adjacent steel plates 54 and 54. The connecting structure between the reinforcing steel plate 10 and the first and second steel plates 21 and 22 is the same as that in Embodiment 5.

According to Embodiment 8, the reinforcing effect of Embodiment 5 can be achieved on the outdoor side of the reinforced concrete column 1, and the reinforcing effect of Embodiment 1 an be achieved on the indoor side of the reinforced concrete column 1.

(Other Embodiments)

It should be noted that the restricting portion provided for the overlapping portions of the steel plates 21, 22 and 54 are not limited to those in the embodiments described above. For example, the restriction portion may be configured such that the friction is increased gradually or incrementally as the amount of the sliding movement of the overlapping portions of the steel plates increases by changing the degree of the concavity and convexity (depth of the concavity and convexity, area of the portions where the concavity and convexity are provided, and the like) provided for the steel plates. Furthermore, the thickness of the overlapping portions of the steel plates may be configured to be increased gradually or incrementally so that the sliding movement of the steel plates will be restricted as the overlapping portions of the steel plates slidably moves.

While the cross-sectional shape of the reinforced concrete column 1 is a quadrilateral in each of the above-mentioned embodiments, the present invention is applicable even if the reinforced concrete column 1 is in different polygonal column shapes (e.g., pentagonal column, hexagonal column, and the like) other than quadrilateral, or is in a round column. In such a case, the folding angle of the steel plates will be in a shape formed along the outer shape of the reinforced concrete column 1. For example, the cross-sectional shape of the steel plates for a round column will be in a circular arc shape, a semicircular shape, or a sectoral shape formed along the outer shape of the round column.

The number of the steel plates is not limited to four; however, the number is determined as appropriate in consideration of the weight during the delivery. When applied to a reinforced concrete column of a quadrilateral pillar, two steel plates having a U-shaped transverse section, for example, may be used. A plurality of steel plates may be connected vertically and attached around the column.

A plurality of reinforcing steel bars may be provided in the longitudinal direction within the space portion. In this case, for example, the reinforcing steel bars may be provided for each corner portion of the space portion.

In Embodiments 4 to 8, a connecting piece 28 of the reinforcing steel plate 10 and a connecting piece 25 of the steel plates 21 and 22 may be connected with each other by fixtures such as a bolt and a nut.

A connecting piece 25 of a first steel plate 21 may be provided inside a connecting piece 28 on one side of a reinforcing steel plate 10, and a connecting piece 25 of a second steel plate 22 may be provided inside a connecting piece 28 on the other side of the reinforcing steel plate 10. In this regard, the overlapping portion of the outer plate 24 of the first steel plate 21 slidably overlaps with the overlapping portion of the outer plate 24 of the second steel plate 22.

In Embodiments 4 to 8 shown in FIGS. 9 to 14, the reinforcing steel plate 10 is fixed by the anchor bolt 55 to a side surface of the column 1; however, the reinforcing steel plate 10 may be fixed to a side surface of the column 1 using adhesive. In that case, it will not be necessary to destroy the reinforced concrete column 1 at all.

While Embodiments 4 to 8 described above are such embodiments where walls are formed on both sides of a column; however, the present invention according to any of Embodiments 4 to 8 is applicable even to such a case of a structure in which a wall is formed on one side of a column, or a case of structure in which a wall continues in an orthogonal manner from adjacent side surfaces of a column.

Furthermore, the present invention according to any of Embodiments 4 to 8 is applicable to the reinforcing of columns in a tunnel, as discussed above. Specifically, when columns in a tunnel are reinforced, the back sides of the columns are in the soil and unreachable for humans. Even in such a case, the construction can be made only from the tunnel side of the columns. Furthermore, the present invention is applicable to the case of reinforcing columns built in subway railroads. Specifically, the present invention according to any of Embodiments 4 to 8 is applicable even if columns are built in between the walls of subway railroads and it is impossible for humans to go around the back surface side of the columns and perform construction.

In each of Embodiments 4 to 8 described above, before or after the step of filling grout material into a space portion formed in between the reinforcing steel plate and the steel plates, it is possible to remove at least a part of the wall.

INDUSTRIAL APPLICABILITY

The present invention provides a reinforcing structure for reinforcing existing columns of a building, such as a reinforced concrete column, a steel-frame reinforced concrete column, a steel pipe concrete column, and a steel frame column, in order to increase the earthquake resistance of the structure.

REFERENCE SIGNS LIST

1 reinforced concrete column
3 space portion
5 reinforcing sheet
6 steel plate
7 grout material
10 reinforcing steel plate
11 fixation plate
13 concave groove
14 metallic washer plate
15 tie bar
16 elongated hole
18 mounting hardware
19 bolt
20 nut
21 first steel plate
22 second steel plate
23 stopper
24 outer plate
25 connecting pieces of first and second steel plates
26 space portion
28 connecting piece of reinforced steel plates
53 wall

The invention claimed is:

1. A reinforcing structure for a concrete column, the reinforcing structure comprising:

a plurality of steel plates, overlapping portions of which are arranged to be slidable relative to one another in a lateral direction by vibration due to an external force;

grout material filled into a space portion formed in between the plurality of steel plates and the concrete column; and a reinforcing sheet with adhesive wound around an outer circumference of the plurality of steel plates, wherein:

the plurality of steel plates are bound by the reinforcing sheet with adhesive.

2. The reinforcing structure for the concrete column according to claim 1, wherein the overlapping portions are provided with a restricting portion for restricting sliding movement of the overlapping portions of the plurality of steel plates.

3. The reinforcing structure for the concrete column according to claim 2, wherein the restricting portion is a friction portion for producing slide resistance to the overlapping portions of the plurality of steel plates.

4. The reinforcing structure for the concrete column according to claim 3, wherein the friction portion is a concavoconvex shape formed on at least one of opposing surfaces of the overlapping portions of the plurality of steel plates.

5. The reinforcing structure for the concrete column according to claim 2, wherein the restricting portion comprises: an elongated hole formed horizontally long in a slide direction in the overlapping portions of one of the steel plates; and a stopper fixed to the overlapping portions of the other of the steel plates, and being inserted into the elongated hole.

6. The reinforcing structure for the concrete column according to claim 5, wherein the stopper is a bolt, and friction between the one of the steel plates and the other of the steel plates is adjusted by screwing a nut into the bolt.

7. The reinforcing structure for the concrete column according to claim 1, wherein the plurality of steel plates are arranged to surround the concrete column.

8. The reinforcing structure for the concrete column according to claim 1, further comprising:

a reinforcing steel plate fixed to a side surface of the concrete column;

wherein the space portion is formed in between the steel plates and the concrete column with the reinforcing steel plate interposed therebetween.

9. The reinforcing structure for the concrete column according to claim 8, wherein:

the reinforcing steel plate comprises: a fixed plate fixed to one side surface of the concrete column; and a pair of connecting pieces each protruding from either of end portions of the fixed plate towards an outdoor side;

the plurality of steel plates comprises: a first steel plate arranged on one side of the reinforcing steel plate; and a second steel plate arranged on the other side of the reinforcing steel plate;

the first and second steel plates each comprises a connecting piece protruding towards an indoor side;

the connecting piece of the first steel plate is connected to one of the connecting pieces of the reinforcing steel plate;

the connecting piece of the second steel plate is connected to the other one of the connecting pieces of the reinforcing steel plate; and the overlapping portion is formed in each of the first and second steel plates.

* * * * *